United States Patent [19]

Ochab

[11] Patent Number: 4,711,449

[45] Date of Patent: Dec. 8, 1987

[54] WEIGHT LIFTING SAFETY DEVICE

[76] Inventor: Douglas C. Ochab, 7712 W. Sunnyside Ave., Norridge, Ill. 60656

[21] Appl. No.: 816,625

[22] Filed: Jan. 6, 1986

[51] Int. Cl.[4] ..... A63B 13/00

[52] U.S. Cl. ..... 272/123; 188/83; 188/166; 188/325; 188/336; 403/344; 403/366

[58] Field of Search ..... 272/93, 103, 117, 118, 272/122, 123, 134, DIG. 4; 248/354.4, 354.5; 403/344, 366, 371; 188/83, 166, 325, 336

[56] References Cited

U.S. PATENT DOCUMENTS

| | | | |
|---|---|---|---|
| 1,699,707 | 1/1929 | Mitchell | 188/83 X |
| 1,953,996 | 4/1934 | Taylor | 188/83 X |
| 2,483,779 | 10/1949 | Mucher | 188/83 |
| 3,189,347 | 6/1965 | Dodger | 272/117 |
| 3,382,953 | 5/1968 | Wilkinson | 188/336 |
| 3,756,597 | 9/1973 | Monti | 272/123 |
| 4,076,430 | 2/1978 | Crook, Jr. | 403/371 X |
| 4,103,887 | 8/1978 | Shoofler | 272/123 |
| 4,205,838 | 6/1980 | McIntosh | 272/123 |
| 4,252,314 | 2/1981 | Ceppo | 272/117 |
| 4,360,198 | 11/1982 | Waulters | 272/117 |
| 4,369,968 | 1/1983 | Price | 272/123 |
| 4,411,425 | 10/1983 | Milnar | 272/123 |
| 4,618,142 | 10/1986 | Joseph, Jr. | 272/123 X |

*Primary Examiner*—Richard J. Apley
*Assistant Examiner*—Robert W. Bahr
*Attorney, Agent, or Firm*—Lockwood, Alex, Fitzgibbon & Cummings

[57] ABSTRACT

A weight lifting safety device having bar and weight support assemblies depending vertically for support on a support surface at a predetermined elevated position, the attachment of the elements of the safety device to a standard bar bell being such as to permit relative rotation therebetween, and in one form of the invention including dampening means to limit such relative rotation, the support system being readily assembled onto and disassembled from a barbell.

12 Claims, 13 Drawing Figures

17
16
15
19
18
23
25
26
22
21
24
20
13

19
15
22
22
18
13
25
23
24
20
23
21
19

17
16
15
14
2
13
10
11
14
15
17
12
16
2

32
33
32
31
31
21
28
29
29
27
30
13
30

29
33
32
27
13
31
21
28
29
31
33
32

WEIGHT LIFTING SAFETY DEVICE

BACKGROUND OF THE INVENTION

The present invention is directed to an improved weight lifting safety device adapted for use in bench-pressing exercises and other types of exercises which involve the use of a weight lifting bar and various combinations of weights applied thereto.

Using the popular exercise of bench-pressing as the primary example, the exerciser or user is positioned prone on a bench which is elevated from the floor. The user supports with his or her hands a weight lifting bar extending transversely of the user, usually across the chest portion, with the bar normally supplied at opposite ends thereof with an equal amount of weight. Thus, in one of the most popular exercises, the user will press the bar and weights vertically upwardly above the user's chest into a position wherein the arms of the user are fully extended. The bar and weights are then lowered and raised in a continuing sequence.

As the aforementioned type of exercise frequently includes the use of heavy weights, often in excess of a total of 100 pounds, a risk of injury to the user exists. For example, during the course of exercising, perspiration can cause the bar to slip from the grasp of the user. Additionally, the user may ultimately exceed his or her total strength and be unable to support the bar and weights with the result that injury to the user can occur.

In order to protect the user from injury in the event of one or more of the aforesaid occurrences, various safety devices have been proposed and used. For example, weight bar stands are positioned along each side of the user free-standing on the floor with appropriate notches formed in the upper portions of the stands to receive the ends of the bar and support the bar and weights at a predetermined elevation. Such elevation or height is selected so as to support the bar and weights in spaced relation above the chest of the user thus not only permitting the user to slide in and out from under the bar but also to prevent the bar from being dropped on the user's chest. This most common type of safety device has disadvantages. The primary disadvantage is that the user must be careful to keep the bar aligned with the supports at all times during the exercising so that, in the event of losing control of the bar, the same will drop along a path which intercepts the support stands.

Other types of safety devices which overcome the aforementioned problem of continuous alignment include preassembled systems wherein support members are mounted directly on the bar and are raised and lowered with the bar by the user. In some instances the support members constitute the weights, which detracts form the versatility that is provided by a standard bar and weight set having removable and interchangable weights, thus either limiting the type of exercise available or at least complicating the procedure followed. In any instance, the existing type of integrated stand and weight lifting system lacks versatility, is often complicated to use and is expensive.

In a weight lifting safety device system wherein the weight supporting stands are attached in some suitable manner to the bar, if the bar and stands are to be rotatable relative to each other, a further problem exists which has not been effectively overcome by existing systems. For complete use of the weight lifting system, it is important to accommodate rapid exercise movements. When there is relative rotation as stated, the safety stands will not always remain in a vertical position so that, in the event that the user loses control over the weight lifting system, the stands may not squarely contact the floor to prevent injury to the user. Thus, the stands are subject to a pendulum effect which can create a serious problem.

SUMMARY OF THE INVENTION

The present invention deals with a weight lifting safety device which will provide elevated support to a weight lifting bar and any weights mounted thereon, the elevation of such support being adjustable to accommodate the size of the user as well as variation in elevation of a bench or other body support used in exercising, the safety device elements being readily attachable and detachable to and from a weight lifting bar so as to permit variations in weight lifting equipment utilized for various purposes, and in the preferred form of the invention, there is provided a rotation dampening means which is most effective in sustaining sufficient vertical positioning of the support stands relative to the supporting surface of floor so that, upon completion of an exercise or loss of control over the weight lifting system, the potential for injury to the user will be minimized.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
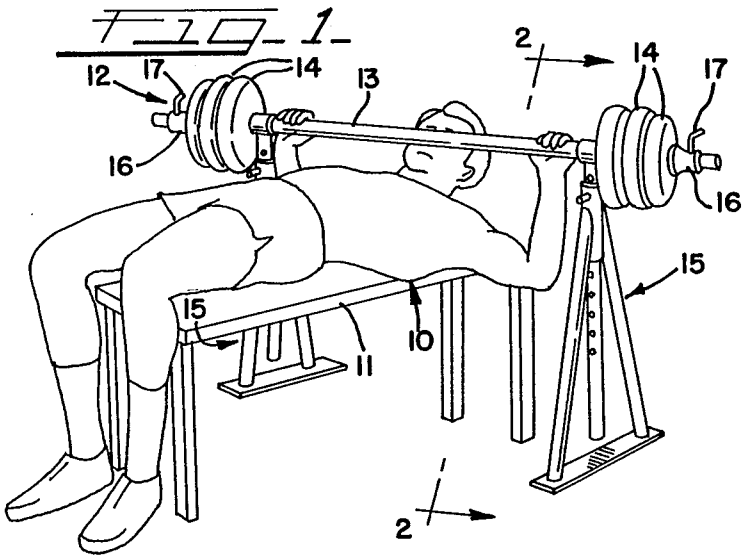
FIG. 1 is a perspective illustration of the assembled weight lifting safety device of the present invention as intended for use by an exerciser graphically illustrated.

FIG. 1 illustrates a conventional form of exercising using the present invention. The user 10 is basically prone on a bench 11 across which and elevated above the chest of the user is the weight lifting and safety device system 12 of the present invention. This system basically includes a weight lifting bar 13 of known type, which supports a plurality of weights 14, again of known type, at opposite ends thereof. In the form of the invention illustrated in FIGS. 1 through 3, the safety device portion of the system includes a pair of bar and weight support assemblies or stands 15 which have a known lifting weight and which are attached to the bar 13 and located adjacent the weights 14.

Weights 14 are locked in position on the bar 13 between the stands 15 and conventional locking collars 16 which are of known type and which include L-shaped set screws 17 which releasably lock the collars 16 to the bar 13. In the orientation shown in FIG. 1, the weight lifting safety system of the present invention is in a position of rest supporting the bar 13 as well as the weights 14 thereon relative to a floor surface which also of course supports the bench 11. The bar 13 is raised sufficiently to clear the chest of the user 10, and the user grasps the bar 13 as illustrated to lift same upwardly for exercising purposes. During such lifting action, the stands 15 will also raise with the bar 13 and are included in the weight load to be lifted by the user.

Figure 3:
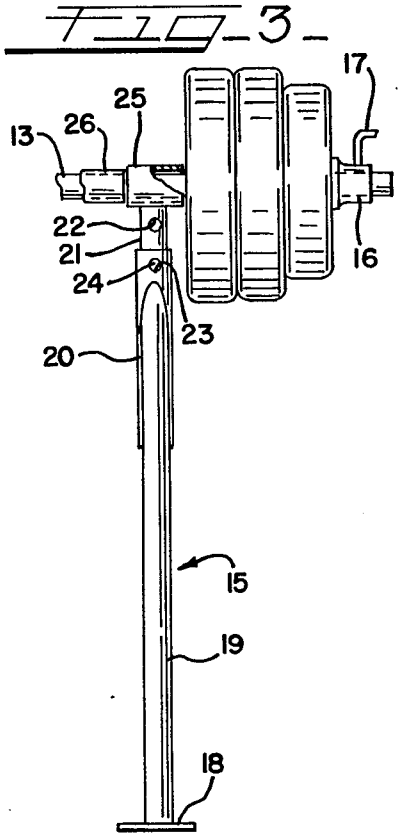
FIG. 3 is a fragmented side elevational view of the end of the device of FIG. 2 with the weights at that end of the bar illustrated.
Figure 2:
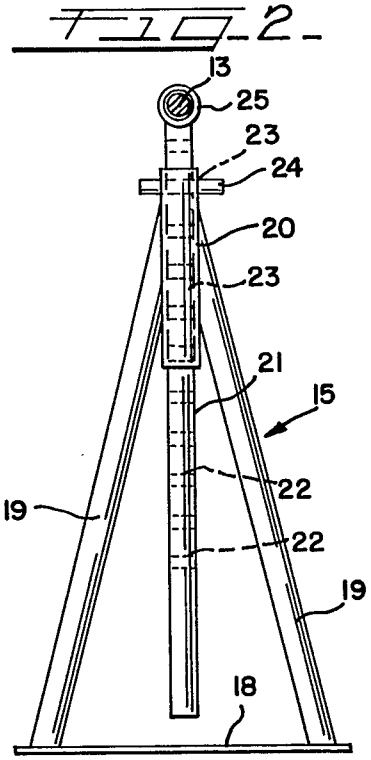
FIG. 2 is a view of the weight lifting safety device taken generally along line 2—2 of FIG. 1 with the weights removed from the end of the bar as viewed.

As shown in FIGS. 2 and 3, each stand 15 includes a base plate 18, upwardly converging legs 19 and a vertical tube member 20 which is suitably fixed to the legs 19 between the upper ends thereof at the upper convergence thereof. Received in the tube 20 is an elongated vertical support member 21 in the form of a bar or tube, the inner diameter of the tube 20 being such as to receive the support member 21 in sliding relationship. Indexing means are provided in the form of a plurality of vertically spaced apertures 22, 23 in the bar 21 and tube 20, respectively. A pin 24 constituting a part of the indexing means is inserted through aligned apertures 22 and 23 so as to fix the bar 21 in a selected vertical position within the tube 20.

Suitably fixed to the top of the bar 21 is a sleeve or tube section 25 which extends transversely of the top end of the vertical support member 21. The weight lifting bar 13 is received within the sleeve 25, and sufficient clearance is provided between the sleeve 25 and the bar 13 to permit relative rotation between the bar 13 and the stands 15. In the embodiment shown in FIG. 3, each stand 15 is positioned longitudinally of the bar 13 adjacent opposite ends thereof by use of a fixed member in the form of a flange or sleeve 26 suitably fixed to the bar 13. Thus the sleeve 25 at one end thereof abuts the fixed member 26 and at the other end thereof is in close association with the most adjacent weight 14.

As can be readily appreciated, the particular structure described permits great ease in mounting and dismounting of the safety device members of the present invention on and from a conventional weight lifting bar. Since the assembled condition of the safety system is illustrated in FIG. 3, dismantling will be described. The set screw 17 of the conventional locking collar 16 is removed, the weights 14 are removed, and the bar 13 and sleeve 25 are disengaged by reason of the clearance between the sleeve 25 and the bar 13. The reverse procedure is followed in connection with mounting of the safety device system on a conventional bar 13. If desired, the safety device system can be mounted outboard of the weights 14 between the same and the locking collar 16, thus eliminating the need for fixed member 26, although means should still be present to prevent inward movement of the innermost weight.

Inasmuch as the vertical bar 21 is slidable within the sleeve or tube 20, the indexing pin 24 may be removed and reinserted through any of the apertures 22 to vary the height of the sleeve 25. Thus, individuals of varying chest sizes may be accommodated. Additionally, the safety device assemblies of the present invention allow for the use of benches of various heights. Different forms of exercise are also readily accommodated by varying the effective height of the stands 15.

The various parts of the stands 15 may be formed from any suitable materials, whether metallic, polymeric, combinations thereof, or the like. The converging legs 19 may be tubes or bars, the bar 21 may be a tube if desired, and the particular form of indexing means described including the use of a pin 24 may be of a different type so long as the function is retained, including ease of height variation. The weights of the stands 15 will vary depending upon the material utilized, and such weight will be precalibrated so that the user will be aware of the amount of additional weight being used during exercising.

Figure 5:
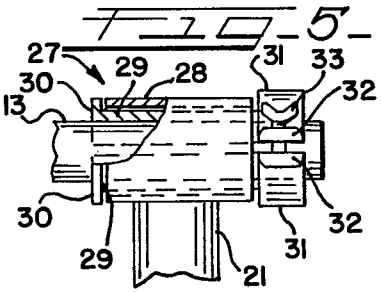
FIG. 5 is a partly sectioned fragmented view of the modified safety device of FIG. 4 in side elevation.
Figure 4:
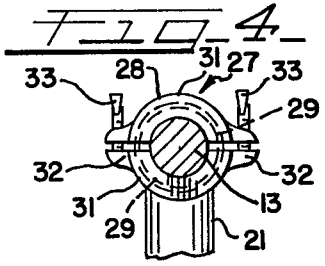
FIG. 4 is a fragmented cross-sectional view of one end of a weight lifting bar and top portion of the safety device attached thereto illustrating a modified form of the subject invention.

FIGS. 4 and 5 illustrate a modified mode of rotatably attaching the stands 15 to the weight lifting bar 13. The modified attachment assembly, generally designated as 27, includes an outer sleeve 28 basically similar to the sleeve 25 but of greater diameter to receive internally an inner sleeve 29, which is preferably radially compressible and at one end thereof is provided with a suitable abutment means in the illustrated form of a vertical flange 30. Such flanges are of sufficient extent to prevent sliding movement of the sleeve 28 beyond the flanged end of the inner sleeve 29. The opposite end of each inner plate or sleeve member 29 also includes abutment means illustrated as being in the form of a collar 31 with the opposite circumferential ends of such collar being provided with outwardly projecting ears 32 suitably threaded in opposed relation to receive wing bolts or screws 33 therethrough. In this manner, releasable fastening means are provided to lock the plates 29 on the weight lifting bar 13 against longitudinal movement relative thereto. The opposed flanges 30 and 31 of the plates 29 confine the rotatable sleeve 28 against any substantial longitudinal movement relative to the bar 13.

In FIGS. 4 and 5, the attachment means is shown in the mounted condition on the bar 13, and dismounting of same is now described. It is necessary merely to loosen or remove the screws 33 so that the inner sleeve 29 can slide along the bar 13 to permit disassembly. In this respect it should be noted that the clearance between the outer sleeve 28 and the inner sleeve 29 may be sufficient to permit rather substantial radial movement therebetween. In operation of the device, it is important that the bar 13 may be rotated relative to the stands 15 so that the exercise has sufficient freedom to utilize all exercising procedures and so that the stands 15 will remain in at least substantially vertical relation relative to the floor. Thus, sufficient clearance is provided between the various parts described to permit ready assembly and disassembly.

Figure 6:
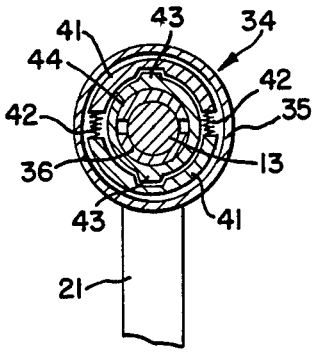
FIG. 6 is fragmented end sectional view of another form of the present invention illustrating a preferred dampening assembly.
Figure 7:
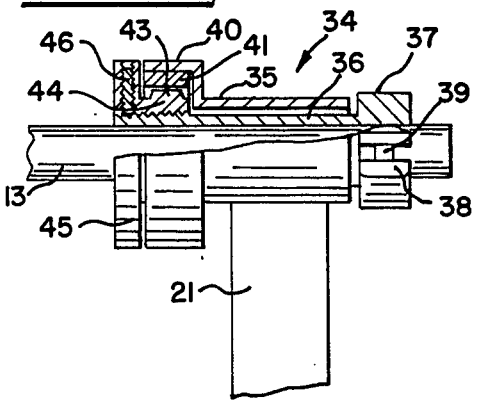
FIG. 7 is a partially sectioned view of a portion of the modified form of safety device of FIG. 6 as viewed generally in side elevation.

As referred to hereinabove, rapid exercise movements can conceivably impart pendulum movement to the stands 15. If such movement occurs, there is the risk of injury in the event that the user loses control of the weight lifting system and the stands 15 do not strike the floor in sufficiently vertical positions to effectively prevent further downward movement of the weight lifting bar and weights. FIGS. 6 and 7 illustrate a bar attachment assembly, generally designated as 34, capable of providing a dampening effect to dampen relative rotation of the stands 15 and the bar 13 so as to maintain sufficient vertical alignment of the stands 15 with the floor. The attachment assembly 34 includes telescoped sleeve-like members in the form of an outer sleeve 35 and a pair of semi-cylindrical inner sleeve members or plates 36. At one end of the arrangement, the inner sleeve or plate members 36 are provided with radially outwardly extending flange portions 37 provided with opposed attaching ears 38 in which removable fastening members 39 such as wing nuts are received to releasably attach the inner plates or sleeves 36, and thus the outer sleeve 35, to the bar 13 against longitudinal movement therealong. The flanges 37 function to prevent longitudinal movement of the outer sleeve 35 relative to the bar 13.

At the opposite end of the outer sleeve 35, an enlarged housing portion 40 is provided which functions as a brake drum along the inner surface thereof. Received within the housing 40 is a friction pad or brake pad of any suitable material, such pad consisting of two pad members 41 of generally semi-cylindrical configuration having spaced opposed edges between which coil springs 42 are received. The friction pads 41 are held against rotation relative to the inner sleeves or plates 36 by splines 43 received in suitable recesses along the inner surfaces of the pads 41, the splines being integrally formed on a spindle 44 threadedly mounted on the outer surfaces of the opposite ends of the inner sleeves or plates 36. The spindle 44 is provided with an enlarged radially directed flange portion 45 which is located outwardly of the adjacent ends of the housing 40 and which confines therein the friction pads 41 and springs 42 while at the same time preventing any substantial longitudinal movement of the outer sleeve 35 along the bar 13. A locking set screw 46 is threadedly received in the enlarged flange 45 and extends into radial engagement with the threads on the outer surfaces of the inner sleeves or plates 36 to lock the spindle 44 against movement relative to the assembly.

The springs 42 function to lightly press the friction pads 41 outwardly against the inner surface of the housing 40. This slight resistance to relative rotation between the bar 13 and safety device is not sufficient to interfere with the effectiveness of any exercise being conducted. As rapid movement occurs during exercising resulting in a substantial increase in relative rotation of the bar 13 to an extent that the functioning of the safety device might be impeded, the combined action of the springs 42 and centrifugal force will cause the friction pads 42 to more tightly engage the housing 40 top provide an increased braking action. Spring strength and clearance between the friction pads and the housing will be selected to meet all contingencies during exercising. Variations in this regard can also be effected by the use of barbell grease and interposing friction varying items such as leather pads at points of rotational engagement. Thus, the stands 15 will be retained in sufficient vertical relation relative to the floor so that, in the event of loss of control of the weight lifting system, the stands will contact the floor in supportive position of the entire system.

Figure 8:
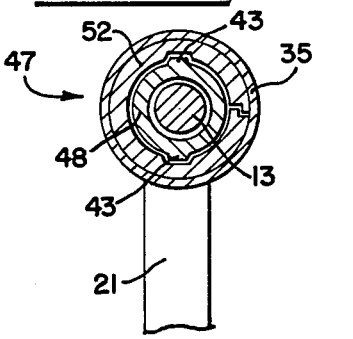
FIG. 8 is a fragmented end sectional view illustrating an alternative dampening assembly.
Figure 9:
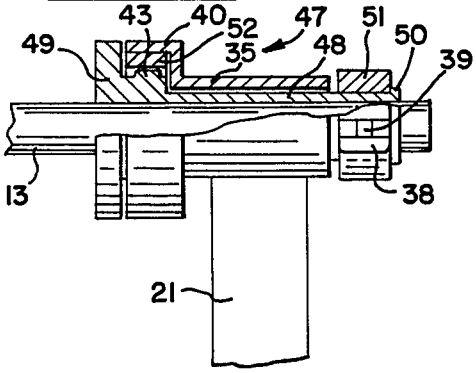
FIG. 9 is a partially sectioned view of a portion of the device of FIG. 8 as viewed generally in side elevation.

The embodiment of FIGS. 8 and 9 also includes an attachment assembly, generally designated as 47, having a braking assembly. Inner sleeves or plates 48 are unitary structures having splines 43 and an enlarged flange 49 at one end and an opposite-end flange 50 that extends beyond collar 51 having the ears 38 and tighten-down member or screw 39 by which the entire assembly 47 is secured onto the bar 13. The braking assembly of this embodiment includes a split ring 52 that is sized to outwardly exert radially directed frictional forces onto the inside surface of the enlarged housing 40 to provide the desired degree of dampening. Split ring 52 may be compressed as inserted and made of a suitable material such as a compressible polymer or the like.

Figure 10:
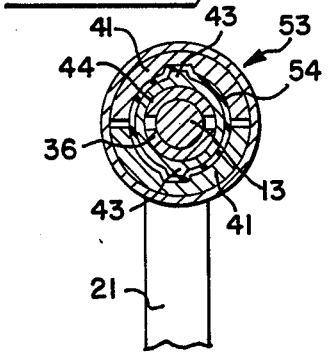
FIG. 10 is a fragmented end sectional view showing a further alternative dampening assembly.
Figure 11:
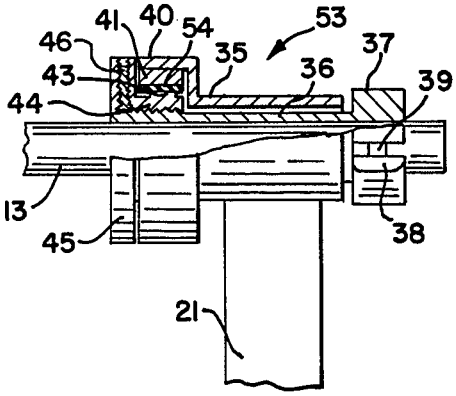
FIG. 11 is a partially sectioned view of a portion of the device of FIG. 10 as viewed generally in side elevation.

FIGS. 10 and 11 illustrate an attachment assembly 53 similar to that of FIGS. 6 and 7, except the outwardly directed radial forces are generated by a resilient pad or O-ring 54 interposed between the spindle 44 and the internal surface of the friction pads 41. The resiliency of the pad or ring 54 forces the external surface of the friction pads against the inner surface of the enlarged housing 40.

Figure 12:
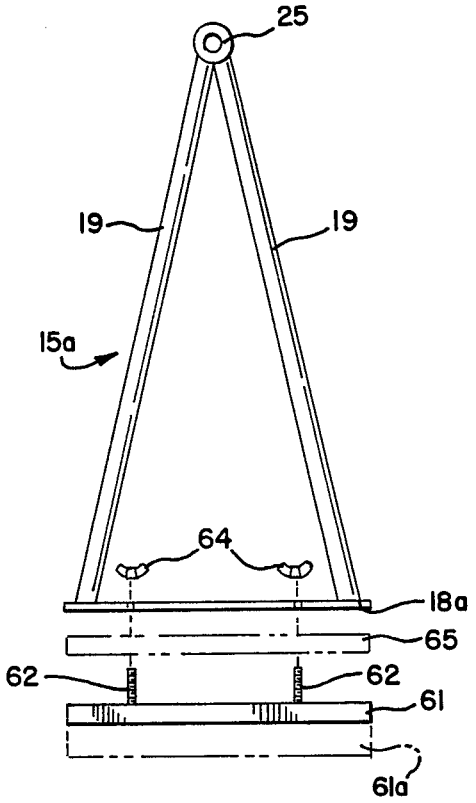
FIG. 12 is an elevational view of an alternative embodiment of the weight lifting safety device.
Figure 13:
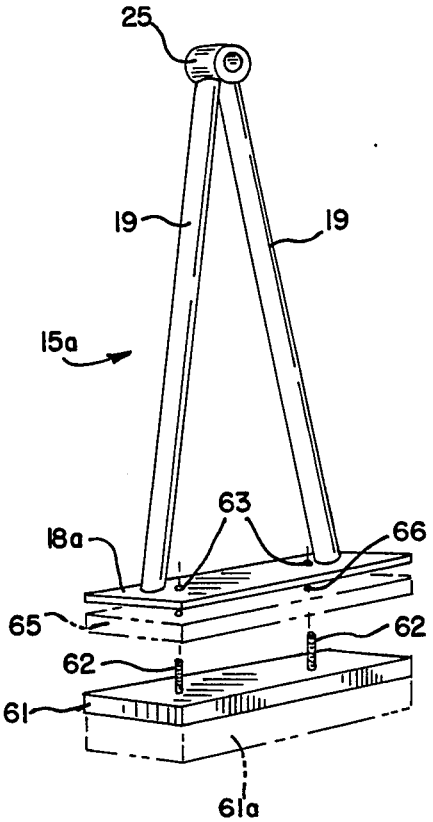
FIG. 13 is a perspective view of the device shown in FIG. 12.

An exceptionally economical height or vertical adjustment assembly, generally designated **15*a*, is illustrated in FIGS. 12 and 13. In this embodiment, adjustability is achieved by providing one or more removable spacers which are readily attached to and removed from the bottom surface of base plate 18*a*. For example, mounting a spacer bottom plate 61 onto the bottom of the base plate 18*a* increases the height of the sleeve 25 and thus of the bar inserted therewithin. Spacer bottom plate 61, which may be constructed of any durable material such as metal or hard polymeric or resinous materials, will be of known weight and typically will be mounted by upstanding bolts 62 or the like securely imbedded therewithin, which pass through apertures 63 in base plate 18*a* and which receive wing nuts 64 or the like. Further adjustability can be achieved by supplying a plurality of spacer bottom plates, each of a different thickness, such as is generally illustrated in phantom at 61*a*. Additional adjustability is provided b intermediate spacers shown in phantom at 65 which incorporate apertures such as the illustrated holes 66**, although slots or the like can also be used.

In addition to the many advantages outlined hereinabove concerning the weight lifting safety device of the present invention, it will be recognized that such device has substantial versatility. For example, different barbells of varying diameter can be used with a given device. In one respect the rotational clearance of the sleeves relative to the barbell can be rather substantial as previously described. Additionally, the use of bifurcated inner sleeves with sufficient circumferential spacing between the adjacent sides of such sleeves will permit use of barbells of varying diameters.

While particular embodiments of the invention have been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

What is claimed is:

1. A weight lifting safety device adapted for use in bench-pressing exercises, said device comprising:

weight supporting bar means for grasping in a horizontal position by a user and for receiving weights on generally opposite ends thereof;

bar and weight support means depending vertically from said bar means adjacent opposite ends thereof to support said bar means and any weights thereon in predetermined elevated position relative to a supporting surface;

an attachment assembly fixed to the upper end of each support means and extending horizontally thereof, each said attachment assembly having a sleeve, said bar means extending through said sleeve of each of said attachment assemblies and being rotatable therein;

locking means on said bar associated with each attachment assembly to fix the positions of said support means longitudinally on said bar; and each of said locking means includes a pair of opposed semi-cylindrical plates provided with external spaced abutment means, fastening means for attaching said plates to said bar, said sleeve being received about each of said locking means between said spaced abutment means, said bar and said locking means being rotatable in said sleeves.

2. The weight lifting safety device of claim 1, wherein said spaced abutment means are raised flanges, and a pair of opposed flanges on each of said locking means have releasable fastening means to clamp said locking means to said bar and to release same to permit dsimantling of said safety device.

3. A weight lifting safety device adapted for use in bench-pressing exerciess, said device comprising:

weight lifiting supporting bar means for grasping in a horizontal position by a user and for receiving weights directly onto opposite ends thereof;

bar and weight support means depending vertically from said bar means adjacent opposite ends thereof to support said bar means and any weights thereon in predetermined elevated position relative to a supporting surface;

bar attachment means on said support means to attach said bar rotatably to said support means;

rotation dampening means interacting between said bar means and said attachment means to dampen the relative rotation between said bar means and said support means;

each bar attachment means includes telescoped inner and outer sleeves with each inner sleeve being fixed to said bar means, and said bar means and inner sleeve are rotatable within the outer sleeve, said dampening means being located between said telescoped inner and outer sleeves; and each of said inner sleeves is provided with external flange means between which the outer sleeve is positioned against transverse relative movement.

4. The weight lifting safety device of claim 3, wherein each of said bar and weight support means includes a horizontal base plate attached to vertically upstanding and converging legs defining an upper convergence portion, as well as a height adjusting assembly including:

a tube member fixed to said upper convergence portion of said legs;

an elongated vertical support member fixed to a sleeve at the upper end thereof and slidably received in said tube member; and indexing means to variably fix the vertical position of said vertical support member within said tube member and relative to said support means.

5. The weight lifting safety device of claim 4, wherein said indexing means includes spaced transverse apertures in both said tube member and support member, and pin means extending through aligned apertures to fixedly position said support member within said tube member.

6. The weight lifting safety device of claim 3, wherein each of said inner sleeves is in the form of semi-cylindrical plates and at one end thereof is provided with releasable fastening means to clamp said plates to said bar and to release the same to permit dismantling of said safety device.

7. The weight lifting safety device of claim 6, wherein the outer sleeve of each bar attachment means is provided with a radially enlarged dampening means housing in which said dampening means is positioned, said housing being located adjacent the end of said inner sleeve opposite from the end provided with said releasable fastening means, the external flange means of said inner sleeve at said opposite end being removably attached to said inner sleeve to permit access to said dampening means for assembly and disassembly of said safety devices.

8. The weight lifting safety device of claim 3, wherein each of said bar and weight support means includes a horizontal base plate attached to vertically upstanding and coverging legs defining an upper convergence portion, as well as a height adjustment assembly including:

a tube member fixed to said upper convergence portion of said legs;

an elongated vertical support member fixed to a sleeve at the upper end thereof and slidably received in said tube member; and indexing means to variably fix the vertical position of said vertical support member within said tube member and relative to said support means.

9. A weight lifting safety device adapted for use in bench-pressing exercises, said device comprising:

weight lifting supporting bar means for grasping in a horizontal position by a user and for receiving weights directly onto opposite ends thereof;

bar and weight support means depending vertically from said bar means adjacent opposite ends thereof to support said bar means and any weights thereon in predetermined elevlated position relative to a supporting surface;

bar attachment means on said support means to attach said bar rotatably to said support means;

rotation damping means interacting between said bar means and said attachment means to dampen the relative rotation between said bar means and said support means; and said rotation dampening means includes ring means for exerting radially directed friction forces between said attachment means and said bar means.

10. The weight lifting safety device of claim 9, wherein said ring means is a friction pad.

11. The weight lifting safety device of claim 9, wherein said ring means is a split ring.

12. A weight lifting safety device adapted for use in bench-pressing exercises, said device comprising:

weight lifting supporting bar means for grasping in a horizontal position by a user and for receiving weights directly onto opposite ends thereof;

bar and weight support means depending vertically from said bar means adjacent opposite end thereof to support said bar means and any weight thereon in predetermined elevated position relative to a supporting surface;

bar attachment means on said support means to attach said bar rotatably to said support means;

rotation dampening means interacting between said bar means and said attachment means to dampen the relative rotation between said bar means and said support means; and said rotation dampening means includes a friction pad that is radially directed by a resilient pad circumferentially positioned with respect to said friction pad.

* * * * *